US007100224B2

(12) United States Patent
Knipfel

(10) Patent No.: US 7,100,224 B2
(45) Date of Patent: Sep. 5, 2006

(54) AMBULANCE COT LOAD WHEEL ASSISTING DEVICE

(75) Inventor: Steve Knipfel, Portage, MI (US)

(73) Assignee: Stryker Corporation, Kalamazoo, MI (US)

( * ) Notice: Subject to any disclaimer, the term of this patent is extended or adjusted under 35 U.S.C. 154(b) by 0 days.

(21) Appl. No.: 10/805,679

(22) Filed: Mar. 19, 2004

(65) Prior Publication Data

US 2005/0204474 A1 Sep. 22, 2005

(51) Int. Cl.
*A61G 1/00* (2006.01)

(52) U.S. Cl. ..... 5/620; 5/625; 5/626

(58) Field of Classification Search ..... 5/625–627, 5/611, 86.1, 620; 296/20, 16; 298/20
See application file for complete search history.

(56) References Cited

U.S. PATENT DOCUMENTS 5,432,966 A * 7/1995 Berta et al. ..... 5/611
5,572,756 A * 11/1996 Muuranen et al. ..... 5/626
6,125,485 A 10/2000 Way et al.
6,203,085 B1 * 3/2001 Ferris ..... 296/20

FOREIGN PATENT DOCUMENTS

GB 2 192 595 1/1988

* cited by examiner

*Primary Examiner*—Suzanne Dino Barrett
*Assistant Examiner*—Fredrick Conley
(74) *Attorney, Agent, or Firm*—Flynn, Thiel, Boutell & Tanis, P.C.

(57) ABSTRACT

An ambulance cot load wheel assisting device configured to effect a lifting of the axis of rotation of the load wheel to a location sufficiently above the floor surface of the cargo area of the ambulance to enable it to roll onto the floor surface in response to the attendant merely pushing the cot into the cargo area.

21 Claims, 7 Drawing Sheets

AMBULANCE COT LOAD WHEEL ASSISTING DEVICE

FIELD OF THE INVENTION

This invention relates to an ambulance cot load wheel assisting device.

BACKGROUND OF THE INVENTION

In recent years, the advancement in emergency medical procedures has required ambulances to be equipped with the latest in technology. This equipment has required the cargo area of the ambulance to be mounted onto a larger vehicle chassis which has resulted in the floor of the cargo area of the ambulance to be further elevated above the ground than had been the case in the past. The higher elevated floors in the cargo area of the ambulance has necessitated ambulance attendants to lift the front or head end of the ambulance cot so that the load wheels would then rest on the elevated floor surface to enable the attendants to thereafter roll the cot into the cargo area. In many situations, the weight of the patient on the ambulance cot is heavy and back injuries and the like are a frequent injury suffered by the ambulance attendants.

Accordingly, the provision of an ambulance cot with a load wheel assisting device is highly desirable in the field.

U.S. Pat. No. 6,203,085 represents one way of accomplishing an assist to the load wheels on an ambulance cot and the subject matter thereof is incorporated herein by reference.

Accordingly, it is an object of this invention to provide an ambulance cot load wheel assisting device which includes a frame mounted on the ambulance cot which supports, in addition to the load wheel, a load wheel assisting device to effect a lifting of the axis of rotation of the load wheel to a location above the floor surface of the cargo area of the ambulance.

It is a further object of the invention to provide an ambulance cot load wheel assisting device, as aforesaid, which is manually set to a load position prior to entry of the ambulance cot into the cargo area of the ambulance.

It is a further object of the invention to provide an ambulance cot load wheel assisting device, as aforesaid, wherein the aforesaid manual setting or positioning of the assisting device is held thereat by one of a detent mechanism or a spring mechanism.

SUMMARY OF THE INVENTION

The objects and purposes of the invention are met by providing an ambulance cot load wheel assisting device which includes a bracket frame configured to be fastened to a frame of the ambulance cot. The bracket frame has first and second vertically spaced axle mountings provided thereon. An elongate first axle is supported on the first axle mounting. The first axle has a first axis extending longitudinally thereof. A first wheel member of a first diameter is supported on the first axle for rotation about the first axis and is configured to engage and roll on a floor surface of a cargo area of the ambulance. An elongate second axle is supported on the second axle mounting. The second axle has a second axis extending longitudinally thereof. A second wheel-like member of a second diameter is supported on a second axle for rotation about the second axis. The first axle mounting and the first axis are oriented in a first horizontal plane spaced below a second horizontal plane containing the second axis supported by the second axle mounting. The first wheel member has a first diameter which is less than a second diameter of the second wheel-like member. The second axle mounting is configured to orient the second horizontal plane above a third horizontal plane containing the floor surface of the cargo area and the first axle mounting is configured to orient the first horizontal plane below the third horizontal plane, both when the ambulance cot is poised for entry into the cargo area. The second wheel-like member is configured to rotate in response to engagement of a periphery thereof with the edge upon entry movement of the ambulance cot into the cargo area to effect a lifting of the first horizontal plane to a location above said third horizontal plane.

BRIEF DESCRIPTION OF THE DRAWINGS

Other objects and purposes of this invention will be apparent to persons acquainted with apparatus of this general type upon reading the following specification and inspecting the accompanying drawings, in which.

DETAILED DESCRIPTION

Figure 1:
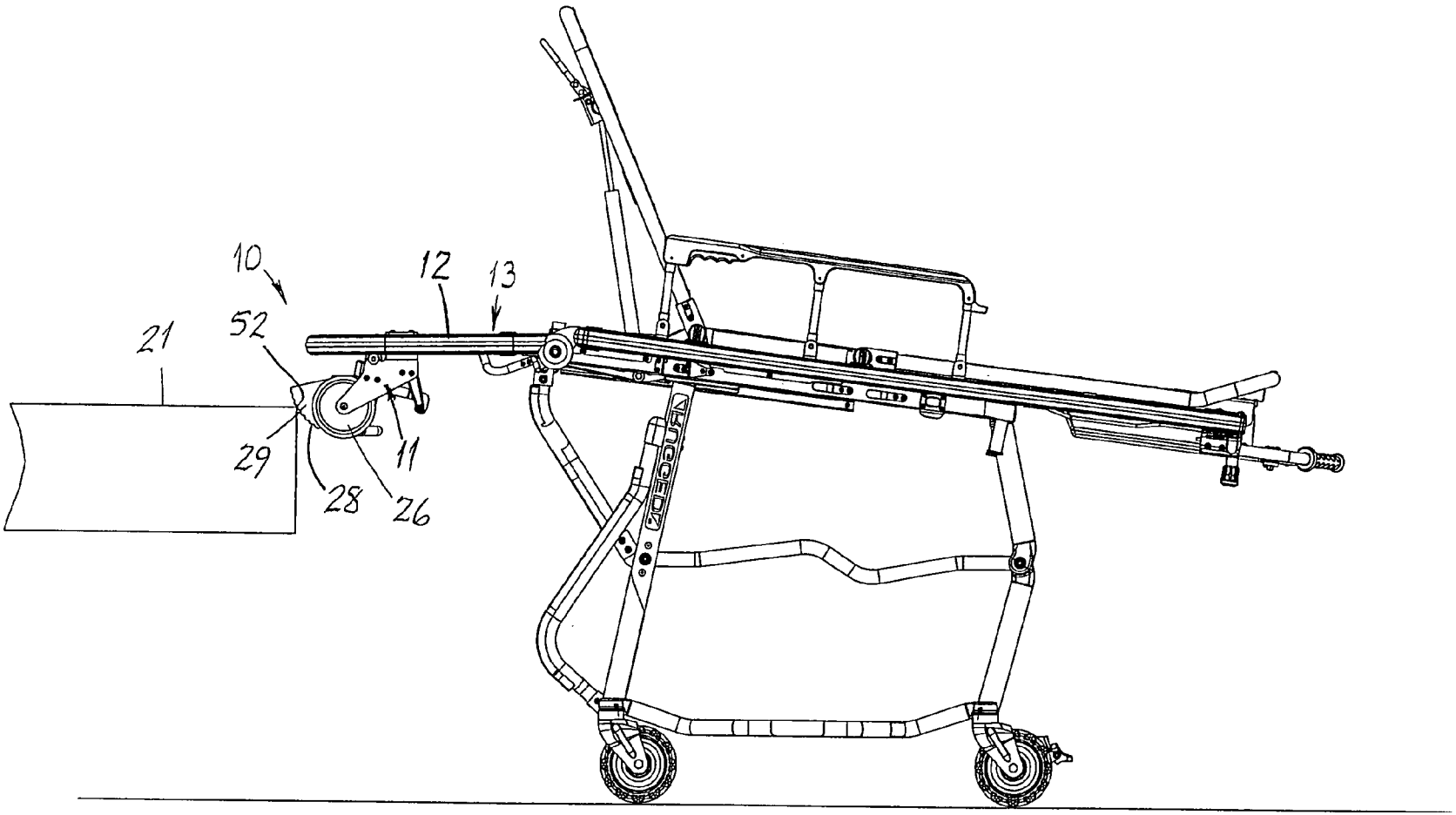
FIG. 1 is a side view of an ambulance cot supported on the ground and poised for entry into the cargo area of an ambulance.
Figure 2:
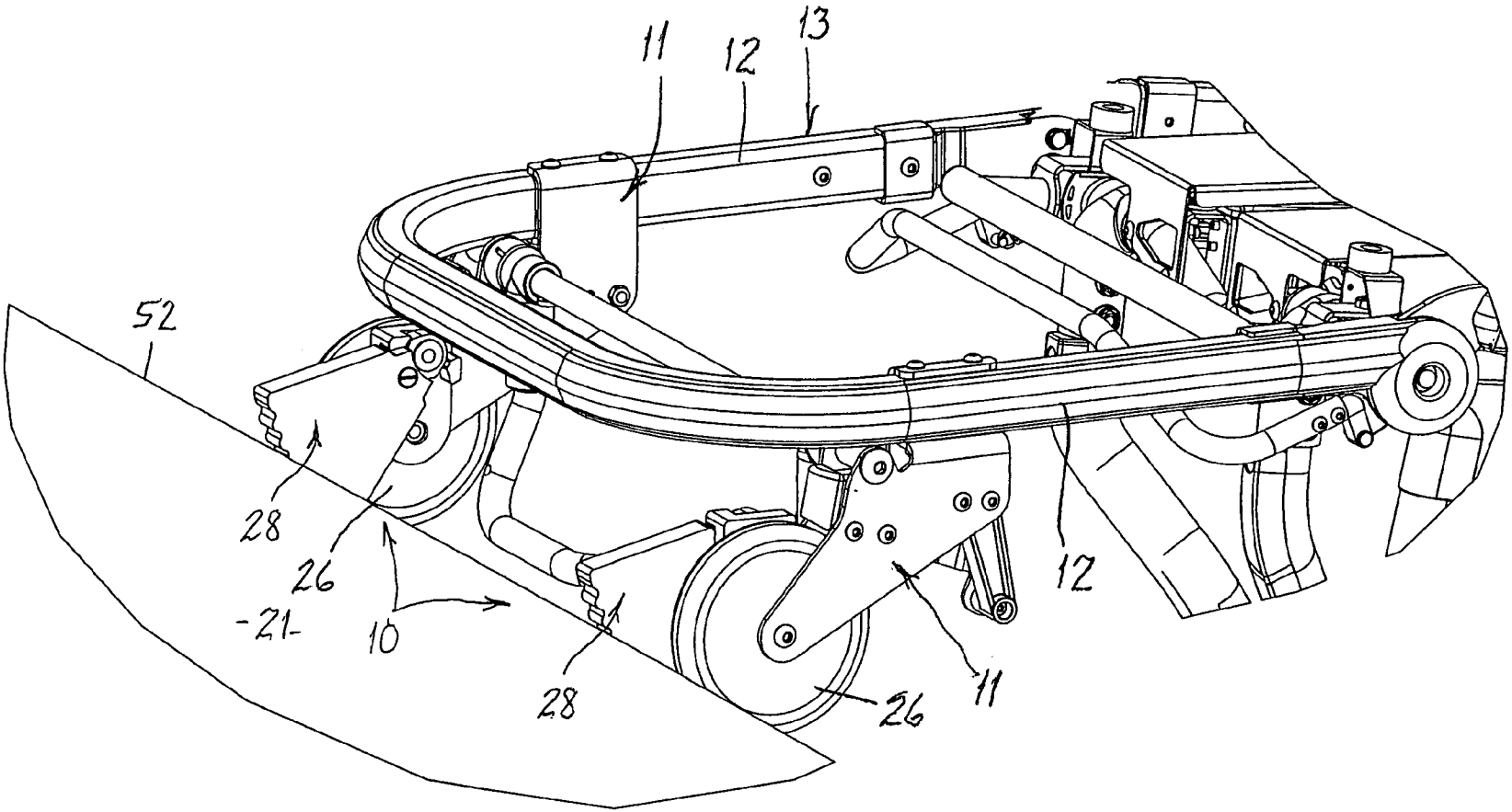
FIG. 2 is an isometric view of the foot end of the ambulance cot poised for entry into the cargo area of the ambulance.

A first embodiment of an ambulance cot load wheel assisting device 10 is illustrated in FIGS. 1 and 2. The load wheel assisting device 10 includes a bracket frame 11 fixedly secured to a tubular frame component 12 of an ambulance cot 13.

The ambulance cot 13 illustrated in the drawings is the subject of U.S. Pat. No. 6,125,485 and is to be incorporated herein by reference. The bracket frame 11 includes, in this particular embodiment, a C-shaped sleeve component 14 that is configured to partially wrap around the tubular configuration of the frame component 12. A pair of fastener members 16 are utilized to prevent longitudinal movement of the bracket frame 11 relative to the cot 13.

The bracket frame 11 also includes first and second vertically spaced axle mountings 17 and 18. In this particular embodiment, the axis 19 of the axle mounting 17 is contained in a horizontal plane that is usually oriented below a plane containing the floor surface 21 of the more recently provided cargo areas 22 on an ambulance. The axis 23 of the axle mounting 18 is oriented in a horizontal plane that is positioned above the floor surface 21.

A load wheel 26 is rotatably supported on the bracket frame 11 by means of an axle 27 having a longitudinal axis that is congruent-with the axis 19. The load wheel 26 is configured to roll on the floor surface 21 during entry of the ambulance cot 13 into the cargo area 22 of the ambulance. Since the axis of rotation 19 of the wheel 26 is usually oriented in a plane beneath the plane of the floor surface 21 when the cot 13 is poised for entry into the cargo area, it will be necessary for an ambulance attendant to lift the head end of the ambulance cot 13 illustrated in FIGS. 2 and 3 vertically upwardly while simultaneously moving the cot into the cargo area 22 to enable the wheel 26 to rest on the floor surface 21. In order to overcome the burdensome task of lifting the ambulance cot, a load wheel assisting device 28 is provided.

The load wheel assisting device 28 is in the form of an arcuate segment of a wheel 29 wherein the angular relationship β between the sides of the segment is in the range of 35° to 50°, the preferable angle being approximately 42°. The arcuate segment 29 is rotatably secured to the bracket frame 11 by an axle 31 whose longitudinal axis is congruent with the axis 23. The axis 23 is oriented in a horizontal plane which is configured to always be oriented above the floor surface 21 of the cargo area 22 of the ambulance when the ambulance cot 13 is poised for entry into the cargo area. The radius $R_2$ of the arcuate segment is greater than the radius $R_1$ of the load wheel 26. Since the axis 23 is oriented vertically above the axis 19, a peripheral surface 30 of the wheel-like segment 29 will lead a peripheral surface 32 of the wheel 26 when the ambulance cot 13 is poised for entry into the cargo area 22. Furthermore, the peripheral surface 30 is serrated as at 33.

The load wheel assisting device 28 is, in the embodiment of FIGS. 1–4, manually set to the position illustrated in FIGS. 1–4. The load wheel assisting device 28 will be held in the FIGS. 1–4 position by a detent mechanism 34 of the type illustrated in FIG. 4. The bracket frame 11 includes a plate 36 on which is provided a pair of arcuately spaced recesses 37 and 38 equidistantly spaced from the axis 23. The detent mechanism 34 includes a reciprocally moveable locking member 39 that is spring urged by a spring 41 into a selected one of the two recesses 37 and 38, the recess 37 being illustrated in FIG. 2. A sufficient amount of force applied to the load wheel assisting device 28 to cause it to rotate about its axle 31 will cause the locking member 39 to effect a yielding of the spring 41 to enable the locking member 39 to exit a selected recess and slide along the surface of the plate 36 toward reception in the next adjacent recess.

Movement of the arcuate segment 29 about the axis 23 of the axle 31 is limited by a pair of arcuately spaced stops 42 and 43.

Figure 5:
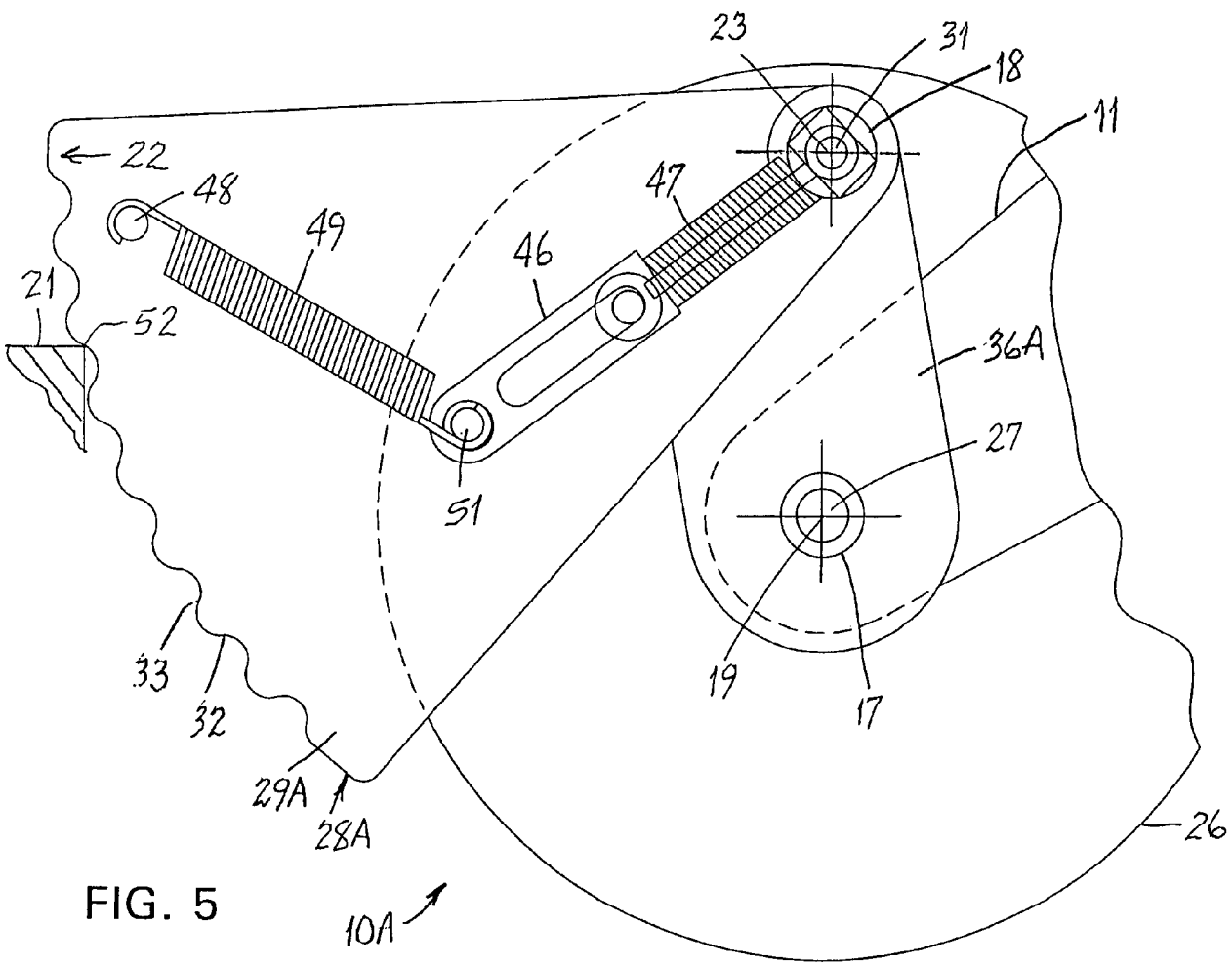
FIG. 5 is a side elevational view of a modified load wheel assisting device.
Figure 6:
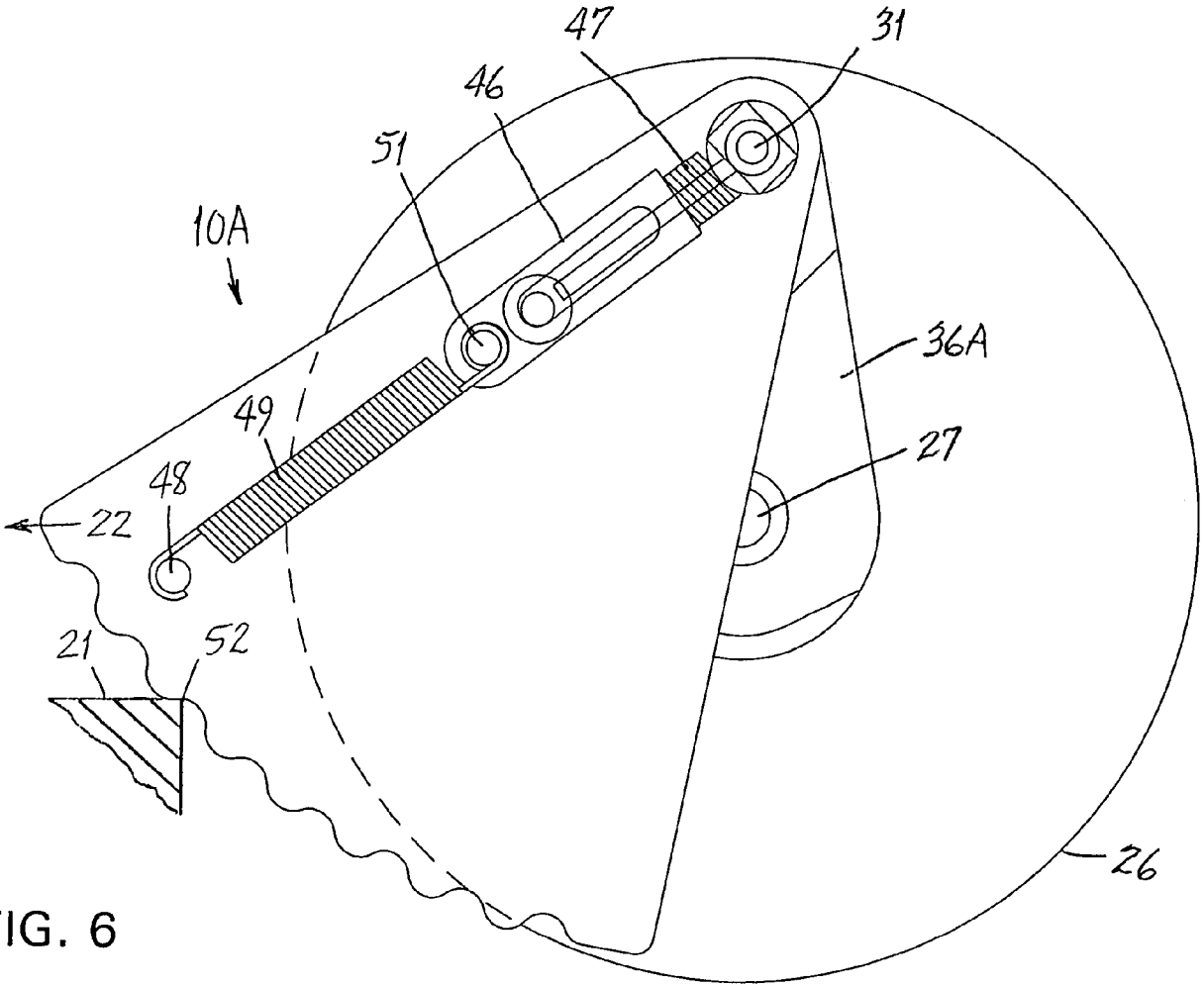
FIG. 6 is a view similar to FIG. 5, but with the assisting device having been shifted to an intermediate position.
Figure 7:
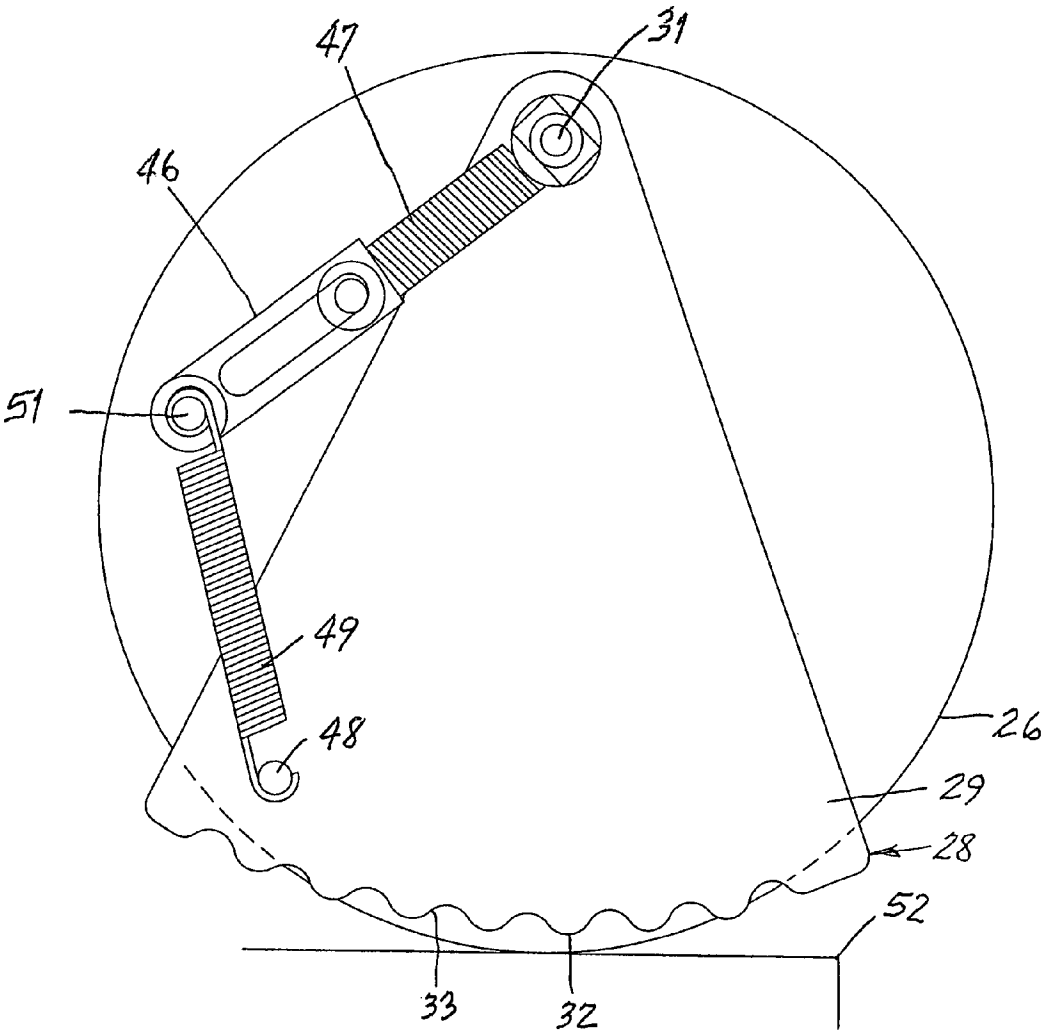
FIG. 7 is a view like FIG. 6, except that the load wheel assisting device has been shifted to a final position occurring after the ambulance cot has been loaded onto the floor surface of a cargo area of an ambulance.

An alternate configuration of the load wheel assisting device 28A is illustrated in FIGS. 5–7. Since the structure of the bracket frame 11 and the support for the wheel 26 are unchanged in this particular embodiment, the reference numerals that have been utilized above will be carried forth in the description of the modified load wheel assisting device 28A. Furthermore, since the arcuate segment 29 is also unchanged, the reference numerals that have been used to describe it above are carried forth in the following description.

Figure 3:
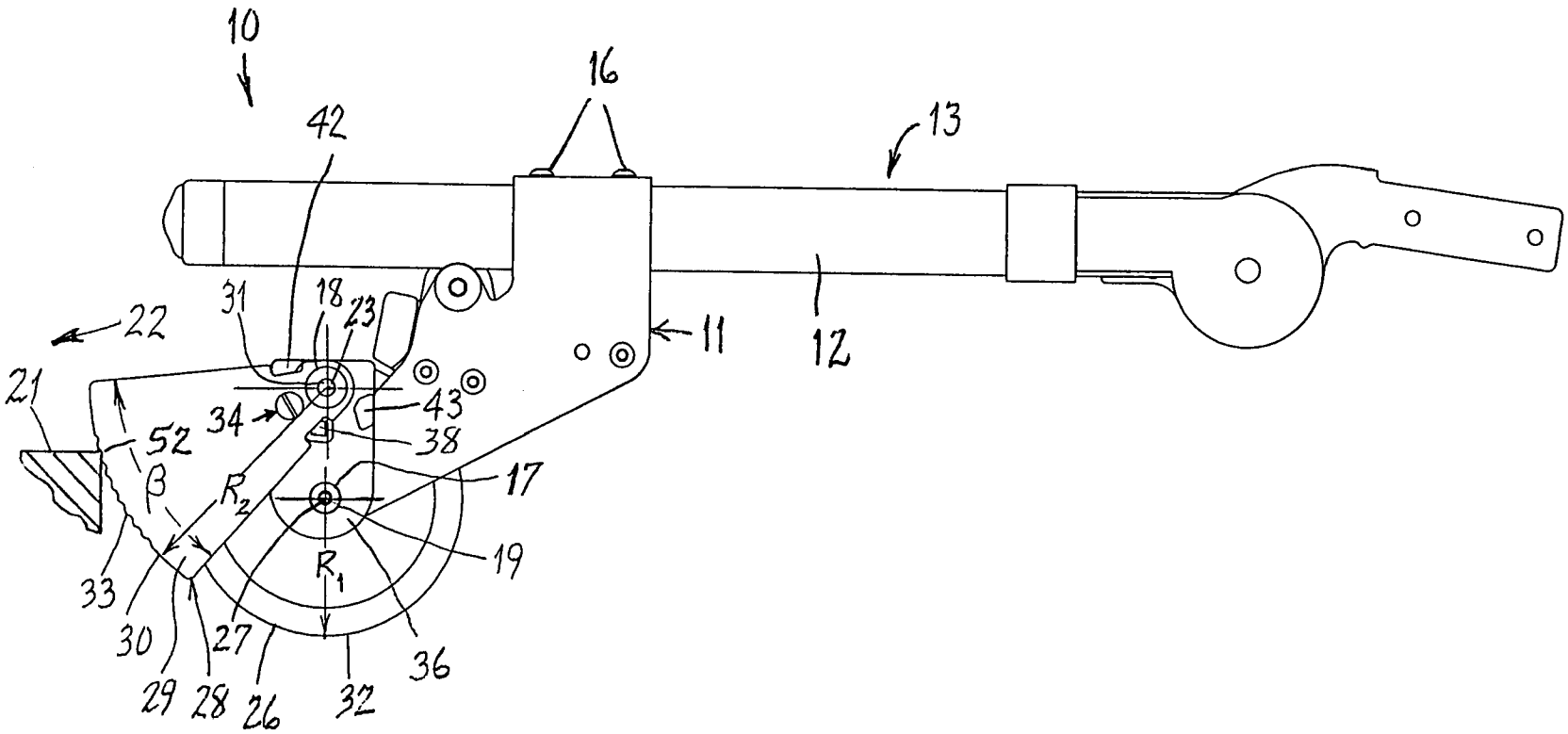
FIG. 3 is a side elevational view of the head end of the ambulance cot wheel assisting device embodying the invention.
Figure 4:
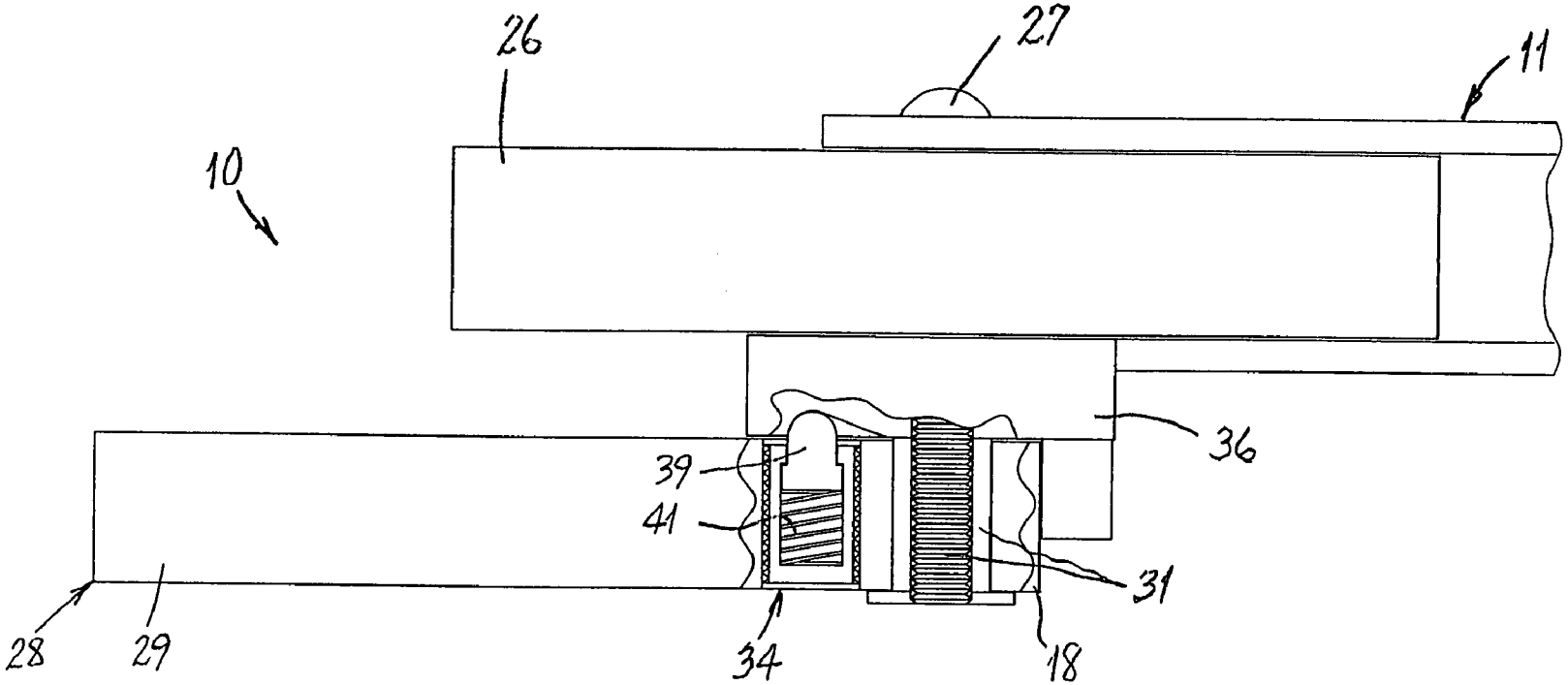
FIG. 4 is a fragmented top view of the load wheel assisting device illustrated in FIG. 3.

The only difference between the alternate embodiment illustrated in FIGS. 5–7 and the embodiment illustrated in FIGS. 1–4 is the provision of a linkage system 44 to resiliently bias the arcuate segment 29 to the load position illustrated in FIG. 3 and the position following loading illustrated in FIG. 5 instead of utilizing the detent mechanism 34. In this alternate embodiment, a first linkage 46 is pivotally secured to the axle 31 and extends radially outwardly therefrom. The linkage 46 is extendable and contractible with the provision of a compression spring 47 urging the linkage to the fully extended position. Extendable and contractible linkage members are well known in the art and will not be described in any further detail other than to state that the fully extended position is illustrated in FIGS. 5 and 7 and the fully contracted position is illustrated in the intermediate position illustrated in FIG. 6. The arcuate segment 29 has a connection post 48 provided thereon. A similar connection post 51 is provided on the linkage 46 near the distal end thereof. A tension spring 49 is connected at one end to the connection post 48 and at the other end to the corresponding connection post 51. The spring 49 is provided for the purpose of enabling the arcuate segment to move further clockwise (FIG. 5) or counterclockwise (FIG. 7) if an unexpected force is applied to the arcuate segment 29. As a result, damage to the linkage 46 and its support will be prevented.

If desired, a pair of tubes or rods (not illustrated) of finite length can be inserted into the interior of the tension spring 41 from opposite ends to prevent the spring from buckling.

If desired, a torsion spring (not illustrated) can be provided to continually urge the wheel-like member 28 counterclockwise to augment or enable the elimination of the spring 47.

OPERATION

Although the operation of the load wheel assisting device described above will be understood from the foregoing description by skilled persons, a summary of such description is now given for convenience.

The arcuate segment 29 of the load wheel assisting device 28 is manually set to the position illustrated in FIGS. 3 and 5. At the locations illustrated in FIGS. 3 and 5, the ambulance cot 13 is poised for entry into the cargo area 22 as illustrated in FIG. 1. The peripheral surface 30 on the arcuate segment is moved into engagement with an edge 52 of the floor surface 21. The edge 52 is contained in the same plane as is the floor surface 21 which, as will be clearly noted in FIGS. 3 and 5, is in a horizontal plane oriented above the horizontal plane containing the axis 19 of the load wheel 26. The ambulance attendants pushing on the ambulance cot 13 causing it to begin to enter into the cargo area 22 will cause the arcuate segment to rotate about the axle 31 to the intermediate position illustrated in FIG. 6. In FIG. 3, the detent mechanism 34 will release and enable the arcuate segment to effect the aforesaid movement. Finally, the arcuate segment will move to the position illustrated in FIG. 7 which will cause, in FIG. 1, the locking member 39 on the detent mechanism 34 to move into the second recess 38 while in the FIG. 7 position, the spring 47 will be allowed to expand to extend the linkage 46 to effect a holding of the arcuate segment 29 in the position illustrated in FIG. 7. In the FIG. 7 position, the horizontal plane containing the axis 19 is now oriented well above the plane containing the floor surface 21 to facilitate an easy rolling movement of the wheel 26 onto the floor surface 21.

During exit of the ambulance cot 13 from the cargo area 22, it will be of interest to note that as the load wheel 26 moves off from the surface 21, the peripheral surface 30 of the arcuate segment 29 will often engage the edge 52 to effect a resetting of the location of the arcuate segment to the positions illustrated in FIGS. 3 and 5.

Although particular preferred embodiments of the invention have been disclosed in detail for illustrative purposes, it will be recognized that variations or modifications of the disclosed apparatus, including the rearrangement of parts, lie within the scope of the present invention.

What is claimed is:

1. In an ambulance cot having a wheel supported base, a frame and an elevating mechanism for varying an elevation of said frame relative to said base, the improvement comprising:

an ambulance cot load wheel assisting device having a bracket frame configured to be immovably fastened to a frame of the ambulance cot, said bracket frame having first and second vertically spaced axle mountings provided thereon;

an elongate first axle supported on said first axle mounting, said first axle having a first axis extending longitudinally thereof;

a first wheel member of a first diameter supported on said first axle for rotation about said first axis and configured to engage and roll on a floor of a cargo area of the ambulance defining a first horizontal plane;

an elongate second axle supported on said second axle mounting, said second axle having a second axis extending longitudinally thereof;

a second wheel-like member of a second diameter supported on said second axle for rotation about said second axis;

said first axle mounting and said first axis being oriented in a second horizontal plane spaced below a third horizontal plane containing said second axis supported by said second axle mounting, said first wheel member having a first diameter which is less than a second diameter of said second wheel-like member;

said second wheel-like member being configured to rotate in response to engagement of a periphery thereof with an edge of the floor of the cargo area upon entry movement of the ambulance cot into the cargo area to effect a lifting of the second horizontal plane to a location above the first horizontal plane if the second horizontal plane is initially oriented below the first horizontal plane; and wherein said bracket frame includes a positioning device for releasably holding said second wheel-like member in at least one position relative to said first axis.

2. The device according to claim 1, wherein an amount of the lifting of said second horizontal plane will cause a periphery of said first wheel member to engage the edge in said first horizontal plane, said first horizontal plane intersecting a radius of said first wheel member at a location that is intermediate of a length of said radius.

3. The device according to claim 2, wherein said intermediate location is in the range of 50% to 100% of a length of said radius measured from said first axis.

4. The ambulance cot load wheel assisting device according to claim 1, wherein said periphery of said second wheel-like member has a non-smooth surface.

5. The ambulance cot load wheel assisting device according to claim 1, wherein said positioning device is a detent mechanism.

6. The ambulance cot load wheel assisting device according to claim 5, wherein said detent mechanism includes at least one recess on said bracket frame and a spring urged locking member mounted on said second wheel-like member and configured to be received in said recess.

7. The ambulance cot load wheel assisting device according to claim 5, wherein said detent mechanism includes at least two arcuately spaced recesses on said bracket frame and a spring urged locking member mounted on said second wheel-like member and configured to be received in a selected one of said recesses.

8. The ambulance cot load wheel assisting device according to claim 1, wherein said positioning device is a pair of pivotally connected links each pivotally connected at ends thereof remote from their pivotal connection to each other to a respective one of said bracket frame and said second wheel-like member, at least one of said links being extendable and contractible and continually resiliently urged toward an extended length thereof to cause said links to form an obtuse angle when said at least one link is in an extended position to hold said second wheel-like member in said at least one position relative to said first axis.

9. The ambulance cot load wheel assisting device according to claim 8, wherein said continual resilient urging is effected by a compression spring provided on said at least one link.

10. The ambulance cot load wheel assisting device according to claim 8, wherein said continual resilient urging is effected by a torsion spring urging said second wheel-like member toward said at least one position relative to said first axis.

11. In an ambulance cot having a wheel supported base, a frame and an elevating mechanism for varying an elevation of said frame relative to said base, the improvement comprising:

an ambulance cot load wheel assisting device having a bracket frame configured to be immovably fastened to a frame of the ambulance cot, said bracket frame having first and second vertically spaced axle mountings provided thereon;

an elongate first axle supported on said first axle mounting, said first axle having a first axis extending longitudinally thereof;

a first wheel member of a first diameter supported on said first axle for rotation about said first axis and configured to engage and roll on a floor of a cargo area of the ambulance defining a first horizontal plane;

an elongate second axle supported on said second axle mounting, said second axle having a second axis extending longitudinally thereof;

a second wheel-like member of a second diameter supported on said second axle for rotation about said second axis;

said first axle mounting and said first axis being oriented in a second horizontal plane spaced below a third horizontal plane containing said second axis supported by said second axle mounting, said first wheel member having a first diameter which is less than a second diameter of said second wheel-like member;

said second wheel-like member being configured to rotate in response to engagement of a periphery thereof with an edge of the floor of the cargo area upon entry movement of the ambulance cot into the cargo area to effect a lifting of the second horizontal plane to a location above the first horizontal plane if the second horizontal plane is initially oriented below the first horizontal plane; and wherein said bracket frame includes a pair of arcuately spaced stops to limit a range of motion of said second wheel-like member to be between said stops.

12. An ambulance cot load wheel assisting device, comprising:

a bracket frame configured to be immovably fastened to a frame of the ambulance cot, said bracket frame having first and second vertically spaced axle mountings provided thereon;

an elongate first axle supported on said first axle mounting, said first axle having a first axis extending longitudinally thereof;

a first wheel member of a first diameter supported on said first axle for rotation about said first axis and configured to engage and roll on a floor of a cargo area of the ambulance defining a first horizontal plane;

an elongate second axle supported on said second axle mounting, said second axle having a second axis extending longitudinally thereof;

a second wheel-like member of a second diameter supported on said second axle for rotation about said second axis;

said first axle mounting and said first axis being oriented in a second horizontal plane spaced below a third horizontal plane containing said second axis supported by said second axle mounting, said first wheel member having a first diameter which is less than a second diameter of said second wheel-like member;

said second wheel-like member being configured to rotate in response to engagement of a periphery thereof with an edge of the floor of the cargo area upon entry movement of the ambulance cot into the cargo area to effect a lifting of the second horizontal plane to a location above the first horizontal plane if the second horizontal plane is initially oriented below the first horizontal plane, said bracket frame including a positioning device for releasably holding said second wheel-like member in at least one position relative to said first axis.

13. The ambulance cot load wheel assisting device according to claim 12, wherein said positioning device is a detent mechanism.

14. The ambulance cot load wheel assisting device according to claim 13, wherein said detent mechanism includes at least one recess on said bracket frame and a spring urged locking member mounted on said second wheel-like member and configured to be received in said recess.

15. The ambulance cot load wheel assisting device according to claim 13, wherein said detent mechanism includes at least two arcuately spaced recesses on said bracket frame and a spring urged locking member mounted on said second wheel-like member and configured to be received in a selected one of said recesses.

16. The ambulance cot load wheel assisting device according to claim 12, wherein said bracket frame includes a pair of arcuately spaced stops to limit a range of motion of said second wheel-like member to be between said stops.

17. The ambulance cot load wheel assisting device according to claim 12, wherein said periphery of said second wheel-like member has a non-smooth surface.

18. An ambulance cot load wheel assisting device, comprising:

a bracket frame configured to be fastened to a frame of the ambulance cot, said bracket frame having first and second vertically spaced axle mountings provided thereon;

an elongate first axle supported on said first axle mounting, said first axle having a first axis extending longitudinally thereof;

a first wheel member of a first diameter supported on said first axle for rotation about said first axis and configured to engage and roll on a floor of a cargo area of the ambulance defining a first horizontal plane;

an elongate second axle supported on said second axle mounting, said second axle having a second axis extending longitudinally thereof;

a second wheel-like member of a second diameter supported on said second axle for rotation about said second axis;

said first axle mounting and said first axis being oriented in a second horizontal plane spaced below a third horizontal plane containing said second axis supported by said second axle mounting, said first wheel member having a first diameter which is less than a second diameter of said second wheel-like member;

said second wheel-like member being configured to rotate in response to engagement of a periphery thereof with an edge of the floor of the cargo area upon entry movement of the ambulance cot into the cargo area to effect a lifting of the second horizontal plane to a location above the first horizontal plane if the second horizontal plane is initially oriented below the first horizontal plane, said bracket frame including a positioning device for releasably holding said second wheel-like member in at least one position relative to said first axis, said positioning device is a pair of pivotally connected links each pivotally connected at ends thereof remote from their pivotal connection to each other to a respective one of said bracket frame and said second wheel-like member, at least one of said links being extendable and contractible and continually resiliently urged toward an extended length thereof to cause said links to form an obtuse angle when said at least one link is in an extended position to hold said second wheel-like member in said at least one position relative to said first axis.

19. The ambulance cot load wheel assisting device according to claim 18, wherein said continual resilient urging is effected by a torsion spring urging said second wheel-like member toward said at least one position relative to said first axis.

20. The ambulance cot load wheel assisting device according to claim 18, wherein said continual resilient urging is effected by a compression spring provided on said at least one link.

21. The ambulance cot load wheel assisting device according to claim 18, wherein said periphery of said second wheel-like member has a non-smooth surface.

* * * * *